US005814390A

United States Patent [19]

Stokes et al.

[11] Patent Number: 5,814,390

[45] Date of Patent: Sep. 29, 1998

[54] CREASED NONWOVEN WEB WITH STRETCH AND RECOVERY

[75] Inventors: Ty Jackson Stokes, Suwanee; Jon Richard Butt, Sr.; Alan Edward Wright, both of Woodstock, all of Ga.

[73] Assignee: Kimberly-Clark Worldwide, Inc., Neenah, Wis.

[21] Appl. No.: 497,484

[22] Filed: Jun. 30, 1995

[51] Int. Cl.[6] ..... D06C 7/02; D06C 27/00; D06J 1/04; A41B 7/00; B32B 3/30

[52] U.S. Cl. ..... 428/181; 2/123; 15/209.1; 28/155; 428/182; 428/219; 428/220; 442/328; 442/353; 442/381; 442/394

[58] Field of Search ..... 428/181, 182, 428/219, 220; 28/155; 2/123; 442/328, 353, 381, 394; 15/209.1

[56] References Cited

U.S. PATENT DOCUMENTS

| | | | |
|---|---|---|---|
| Re. 31,599 | 6/1984 | Rasen et al. | 156/167 |
| 1,883,526 | 10/1932 | Bryan | 162/117 |
| 2,164,702 | 7/1939 | Davidson | 93/1 |
| 2,774,525 | 12/1956 | Angevine, Jr. | 223/32 |
| 2,792,841 | 5/1957 | Larson | 131/208 |
| 2,801,638 | 8/1957 | Schur et al. | 131/208 |
| 2,923,298 | 2/1960 | Dockstader et al. | 128/296 |
| 2,954,036 | 9/1960 | Schur et al. | 131/208 |
| 2,957,512 | 10/1960 | Wade et al. | 154/33.05 |
| 3,002,873 | 10/1961 | Pickren | 156/205 |
| 3,022,545 | 2/1962 | Wylde et al. | 19/66 |
| 3,077,655 | 2/1963 | Runton | 26/18.5 |
| 3,079,929 | 3/1963 | Mueller | 131/208 |
| 3,085,608 | 4/1963 | Mathues | 150/1 |
| 3,104,998 | 9/1963 | Gelpke | 161/109 |
| 3,161,557 | 12/1964 | Muller | 156/462 |
| 3,173,426 | 3/1965 | Touey et al. | 131/208 |
| 3,180,911 | 4/1965 | Muller | 264/119 |
| 3,188,372 | 6/1965 | Roos | 264/287 |
| 3,214,795 | 11/1965 | Hannauer, Jr. et al. | 18/10 |
| 3,220,057 | 11/1965 | Walton | 18/19 |
| 3,292,619 | 12/1966 | Egler | 128/156 |
| 3,293,719 | 12/1966 | Hitomi et al. | 28/1 |
| 3,315,676 | 4/1967 | Cooper | 128/287 |
| 3,349,431 | 10/1967 | Rasmussen | 18/1 |

(List continued on next page.)

FOREIGN PATENT DOCUMENTS

| | | | |
|---|---|---|---|
| 0502237A1 | 10/1961 | European Pat. Off. | B29C 59/04 |
| 0360929A1 | 4/1990 | European Pat. Off. | A61F 13/00 |
| 0399591A1 | 11/1990 | European Pat. Off. | B29C 51/22 |
| 0598970A1 | 6/1994 | European Pat. Off. | B26F 1/24 |
| A-1146780 | 11/1957 | France . | |
| A-2361222 | 3/1978 | France | B31F 1/12 |
| 2239455 | 2/1974 | Germany . | |
| 2614160 | 10/1977 | Germany . | |
| 93/11725 | 6/1993 | WIPO | A61F 13/15 |
| 93/15701 | 9/1993 | WIPO | A61F 13/46 |
| 95/04654 | 2/1995 | WIPO | B32B 27/12 |
| 95/34264 | 12/1995 | WIPO | A61F 13/15 |

OTHER PUBLICATIONS

Van A. Wente, "Superfine Thermoplastic Fibers", Industrial and Engineering Chemistry, vol. 48, No. 8, (1956) pp. 1342–1346.

Database WPI Section Ch, Week 9624 Derwent Publications Ltd., London, GB; AN 96–236597 XP002015653.

JP A–08 092 852 (Daiwabo Co Ltd), 9 Apr. 1996 See Abstract.

*Primary Examiner*—James C. Cannon

*Attorney, Agent, or Firm*—William D. Herrick

[57] ABSTRACT

Nonwoven fabrics having a desirable level of bulk, elasticity and low permanent set are produced by creasing a precursor web and heat setting the creases. Such webs may have varying basis weights and compositions depending on the intended end use. Applications disclosed include components for personal care products such as disposable diapers and feminine hygiene products, for example, as well as garment applications such as training pants, surgical gowns and the like. Also, absorbent products such as wipers are disclosed. Methods for forming the creased nonwoven fabric are disclosed using interdigitated rolls for creasing in the machine direction or in the cross-machine direction.

26 Claims, 6 Drawing Sheets

U.S. PATENT DOCUMENTS

| | | | |
|---|---|---|---|
| 3,390,218 | 6/1968 | Painter et al. | 264/282 |
| 3,408,776 | 11/1968 | Kalwaites | 51/324 |
| 3,427,376 | 2/1969 | Dempsey | 264/282 |
| 3,445,886 | 5/1969 | Lemoine et al. | 18/1 |
| 3,484,839 | 12/1969 | Neumann | 264/282 |
| 3,496,259 | 2/1970 | Guenther | 264/156 |
| 3,496,260 | 2/1970 | Guenther et al. | 264/156 |
| 3,507,943 | 4/1970 | Such et al. | 264/103 |
| 3,509,007 | 4/1970 | Kalwaites | 161/110 |
| 3,513,054 | 5/1970 | Carrel | 156/292 |
| 3,518,921 | 7/1970 | Muller | 93/1 |
| 3,564,677 | 2/1971 | Kalwaites | 28/1 |
| 3,565,729 | 2/1971 | Hartmann | 156/441 |
| 3,654,060 | 4/1972 | Goldman | 161/112 |
| 3,692,618 | 9/1972 | Dorschner et al. | 161/72 |
| 3,695,801 | 10/1972 | Matsushita et al. | 425/193 |
| 3,717,532 | 2/1973 | Kamp | 156/199 |
| 3,719,736 | 3/1973 | Woodruff | 264/156 |
| 3,762,255 | 10/1973 | Clash et al. | 83/309 |
| 3,765,974 | 10/1973 | Petersik et al. | 156/84 |
| 3,773,587 | 11/1973 | Flewwelling | 156/201 |
| 3,789,710 | 2/1974 | Silverstein | 83/16 |
| 3,792,952 | 2/1974 | Hamon | 425/343 |
| 3,795,571 | 3/1974 | Prentice | 161/148 |
| 3,802,817 | 4/1974 | Matsuki et al. | 425/66 |
| 3,804,695 | 4/1974 | Randall et al. | 156/441 |
| 3,811,957 | 5/1974 | Buntin | 136/146 |
| 3,816,583 | 6/1974 | Kashima et al. | 264/282 |
| 3,847,045 | 11/1974 | Willhite, Jr. et al. | 83/37 |
| 3,854,861 | 12/1974 | Worrall | 425/504 |
| 3,881,381 | 5/1975 | Kalwaites | 83/170 |
| 3,881,489 | 5/1975 | Hartwell | 128/287 |
| 3,925,863 | 12/1975 | Meyer | 26/1 |
| 3,929,135 | 12/1975 | Thompson | 128/287 |
| 3,939,536 | 2/1976 | Ruppe | 26/2 R |
| 3,949,128 | 4/1976 | Ostermeier | 428/152 |
| 3,953,638 | 4/1976 | Kemp | 428/154 |
| 3,957,564 | 5/1976 | Lambert et al. | 156/497 |
| 3,965,906 | 6/1976 | Karami | 128/287 |
| 3,966,912 | 6/1976 | Fair et al. | 264/118 |
| 3,978,185 | 8/1976 | Buntin et al. | 264/93 |
| 3,985,600 | 10/1976 | Blais | 156/229 |
| 4,041,203 | 8/1977 | Brock et al. | 428/157 |
| 4,070,218 | 1/1978 | Weber | 156/167 |
| 4,088,731 | 5/1978 | Groome | 264/282 |
| 4,093,499 | 6/1978 | Naka | 156/498 |
| 4,116,892 | 9/1978 | Schwarz | 521/62 |
| 4,134,948 | 1/1979 | Baker, Jr. | 264/518 |
| 4,144,008 | 3/1979 | Schwarz | 425/66 |
| 4,153,664 | 5/1979 | Sabee | 264/289 |
| 4,177,102 | 12/1979 | Tokuno | 156/472 |
| 4,189,344 | 2/1980 | Busker | 162/117 |
| 4,201,801 | 5/1980 | Hori | 427/274 |
| 4,223,059 | 9/1980 | Schwarz | 428/198 |
| 4,248,822 | 2/1981 | Schmidt | 264/154 |
| 4,276,336 | 6/1981 | Sabee | 428/132 |
| 4,278,482 | 7/1981 | Poteet et al. | 156/78 |
| 4,280,978 | 7/1981 | Dannheim et al. | 264/156 |
| 4,285,100 | 8/1981 | Schwarz | 19/161.1 |
| 4,325,773 | 4/1982 | Schulz | 156/471 |
| 4,333,784 | 6/1982 | McCarthy | 156/252 |
| 4,372,312 | 2/1983 | Fendler et al. | 128/290 R |
| 4,374,888 | 2/1983 | Bornslaeger | 428/198 |
| 4,397,644 | 8/1983 | Matthews et al. | 604/378 |
| 4,397,704 | 8/1983 | Frick | 156/201 |
| 4,400,227 | 8/1983 | Riemersma | 156/73.1 |
| 4,405,297 | 9/1983 | Appel et al. | 425/72 S |
| 4,414,045 | 11/1983 | Wang et al. | 156/73.2 |
| 4,418,123 | 11/1983 | Bunnelle et al. | 428/517 |
| 4,422,892 | 12/1983 | Plant | 156/209 |
| 4,430,148 | 2/1984 | Schaefer | 156/580.2 |
| 4,463,045 | 7/1984 | Ahr et al. | 428/131 |
| 4,469,734 | 9/1984 | Minto et al. | 428/134 |
| 4,483,728 | 11/1984 | Bauernfeind | 156/209 |
| 4,488,923 | 12/1984 | Pieniak | 156/199 |
| 4,517,714 | 5/1985 | Sneed et al. | 28/103 |
| 4,525,407 | 6/1985 | Ness | 428/138 |
| 4,531,996 | 7/1985 | Sukenik | 156/472 |
| 4,559,050 | 12/1985 | Iskra | 604/368 |
| 4,588,630 | 5/1986 | Shimalla | 428/131 |
| 4,618,384 | 10/1986 | Sabee | 156/205 |
| 4,629,457 | 12/1986 | Ness | 604/382 |
| 4,629,525 | 12/1986 | Rasmussen | 156/84 |
| 4,650,481 | 3/1987 | O'Connor et al. | 604/380 |
| 4,690,679 | 9/1987 | Mattingly, III et al. | 604/383 |
| 4,704,113 | 11/1987 | Schoots | 604/379 |
| 4,710,186 | 12/1987 | DeRossett et al. | 604/383 |
| 4,726,976 | 2/1988 | Karami et al. | 428/137 |
| 4,755,413 | 7/1988 | Morris | 428/138 |
| 4,781,962 | 11/1988 | Zamarripa et al. | 428/138 |
| 4,798,604 | 1/1989 | Carter | 604/383 |
| 4,806,300 | 2/1989 | Walton et al. | 264/288.8 |
| 4,820,294 | 4/1989 | Morris | 604/383 |
| 4,834,741 | 5/1989 | Sabee | 604/385.2 |
| 4,842,794 | 6/1989 | Hovis et al. | 264/145 |
| 4,854,984 | 8/1989 | Ball et al. | 156/73.5 |
| 4,874,457 | 10/1989 | Swieringa | 156/474 |
| 4,919,738 | 4/1990 | Ball et al. | 156/73.5 |
| 4,921,643 | 5/1990 | Walton et al. | 264/282 |
| 5,028,289 | 7/1991 | Rasmussen | 156/229 |
| 5,041,255 | 8/1991 | Zafiroglu | 264/288.8 |
| 5,057,361 | 10/1991 | Sayovitz et al. | 428/290 |
| 5,078,935 | 1/1992 | Kobayashi et al. | 264/103 |
| 5,113,559 | 5/1992 | LaRoche et al. | 29/121.1 |
| 5,185,052 | 2/1993 | Chappell et al. | 156/462 |
| 5,188,265 | 2/1993 | Capy | 223/32 |
| 5,207,962 | 5/1993 | Hovis et al. | 264/145 |
| 5,244,716 | 9/1993 | Thornton et al. | 428/198 |
| 5,257,923 | 11/1993 | Kagawa | 425/290 |
| 5,262,107 | 11/1993 | Hovis et al. | 264/145 |
| 5,265,506 | 11/1993 | Aihara et al. | 83/16 |
| 5,336,552 | 8/1994 | Strack et al. | 428/224 |
| 5,366,782 | 11/1994 | Curro et al. | 428/137 |
| 5,376,198 | 12/1994 | Fahrenkrug et al. | 156/164 |
| 5,382,400 | 1/1995 | Pike et al. | 264/168 |

CREASED NONWOVEN WEB WITH STRETCH AND RECOVERY

BACKGROUND OF THE INVENTION

1. Field of the Invention

The present invention is directed to nonwoven fabrics useful for a wide variety of applications. Such nonwovens in the form of lightweight, soft, porous webs are used as cover liners for personal care products such as sanitary napkins and disposable diapers, for example. Other embodiments of nonwovens having engineered capillary structures are useful, for example, as intermediate transfer layers for such personal care products acting to distribute fluids and minimize leakage. Still others, frequently in heavier basis weights, are highly absorbent and serve as the absorbent medium for personal care products. In addition to nonwovens for personal care applications, the field of the invention embraces nonwovens for many other uses, for example in the household as cleaning materials and wipers, in the service product area as towels, bathmats and the like, in the automotive and marine areas for scrubbing, wiping, protective and other uses and in the hospital and veterinary areas as garments, drapes, wipes and applicators. The field includes nonwoven fabrics broadly for these and many other uses which will be apparent in light of the description below and preferred embodiments of which will be set forth hereinafter in detail. Moreover, the field embraces methods and apparatus for manufacturing such nonwovens resulting in engineered, three-dimensionally creased webs.

2. General Background

The manufacture of nonwoven fabrics is a highly developed art. In general, nonwoven webs and their manufacture involve forming filaments or fibers and depositing them on a carrier in such manner so as to cause the filaments or fibers to overlap or entangle as a mat of a desired basis weight. The bonding of such a mat may be achieved simply by entanglement or by other means such as adhesive, application of heat and/or pressure to thermally responsive fibers, or, in some cases, by pressure alone. While many variations within this general description are known, two commonly used processes are referred to as spunbonding and meltblowing. Spunbonded nonwoven structures are defined in numerous patents including, for example, U.S. Pat. No. 3,565,729 to Hartmann dated Feb. 23, 1971, U.S. Pat. No. 4,405,297 to Appel and Morman dated Sep. 20, 1983, U.S. Pat. No. 3,802,817 to Matsuki dated Apr. 9, 1974 and U.S. Pat. No. 3,692,618 to Dorschner, Carduck, and Storkebaum dated Sep. 19, 1972. Discussion of the meltblowing process may also be found in a wide variety of sources including, for example, an article entitled, "Superfine Thermoplastic Fibers" by Wendt in *Industrial and Engineering Chemistry*, Volume 48, No. 8, (1956) pages 1342–1346 as well as U.S. Pat. No. 3,978,185 to Buntin, Keller and Harding dated Aug. 31, 1976, U.S. Pat. No. 3,795,571 to Prentice dated Mar. 5, 1974, and U.S. Pat. No. 3,811,957 to Buntin dated May 21, 1974. Spunbonded webs and meltblown webs are widely used for many applications, including personal care products as described, for example, in U.S. Pat. No. 4,397,644 to Matthews, Allison, Woon, Stevens and Bomslaeger, dated Aug. 9, 1983 or U.S. Pat. No. 4,372,312 to Fendler and Bemardin dated Feb. 8, 1983. Other nonwoven manufacturing processes include carding, wetlaying and needling, but the invention will be described with particular reference to meltblown and spunbonded webs which represent preferred embodiments.

In addition to processes for making nonwovens, in general, it is also known to form nonwoven fabrics broadly into corrugated or creped structures for various purposes. For example, nonwoven fabrics may be formed into cigarette filters by directing the web through a horn as described in U.S. Pat. No. 2,164,702 to Davidson dated 4 Jul., 1939. The use of corrugations to add bulk and softness to nonwoven webs is also known.

Notwithstanding the intense investigation into the subject, there remains desired for the above applications and others a lightweight, bulky nonwoven fabric that can be produced with a controlled degree of stretch and recovery properties as well as other benefits and a process for producing such a fabric.

SUMMARY OF THE INVENTION

In accordance with the present invention there is provided an improved nonwoven fabric made from a nonelastic precursor web having permanent creases of at least about 2 per centimeter measured orthogonal to the crease lines and a bulk after creasing of at least about 1.5 times the thickness of the base web, with the nonwoven fabric having a recovery of at least about 35%, preferably at least about 60 percent when stretched 10 percent in a direction orthogonal to the crease lines. In accordance with the invention the lines of creases may be either in the machine direction or in the cross-machine direction as the web is produced. Additionally, the web defined may be combined with one or more other web structures in composite materials having particularly advantageous properties. The process of the invention uses controlled application of heat to the creased web to impart memory and permanent recovery properties. Specific applications for these materials are also included.

DETAILED DESCRIPTION

Figure 1:
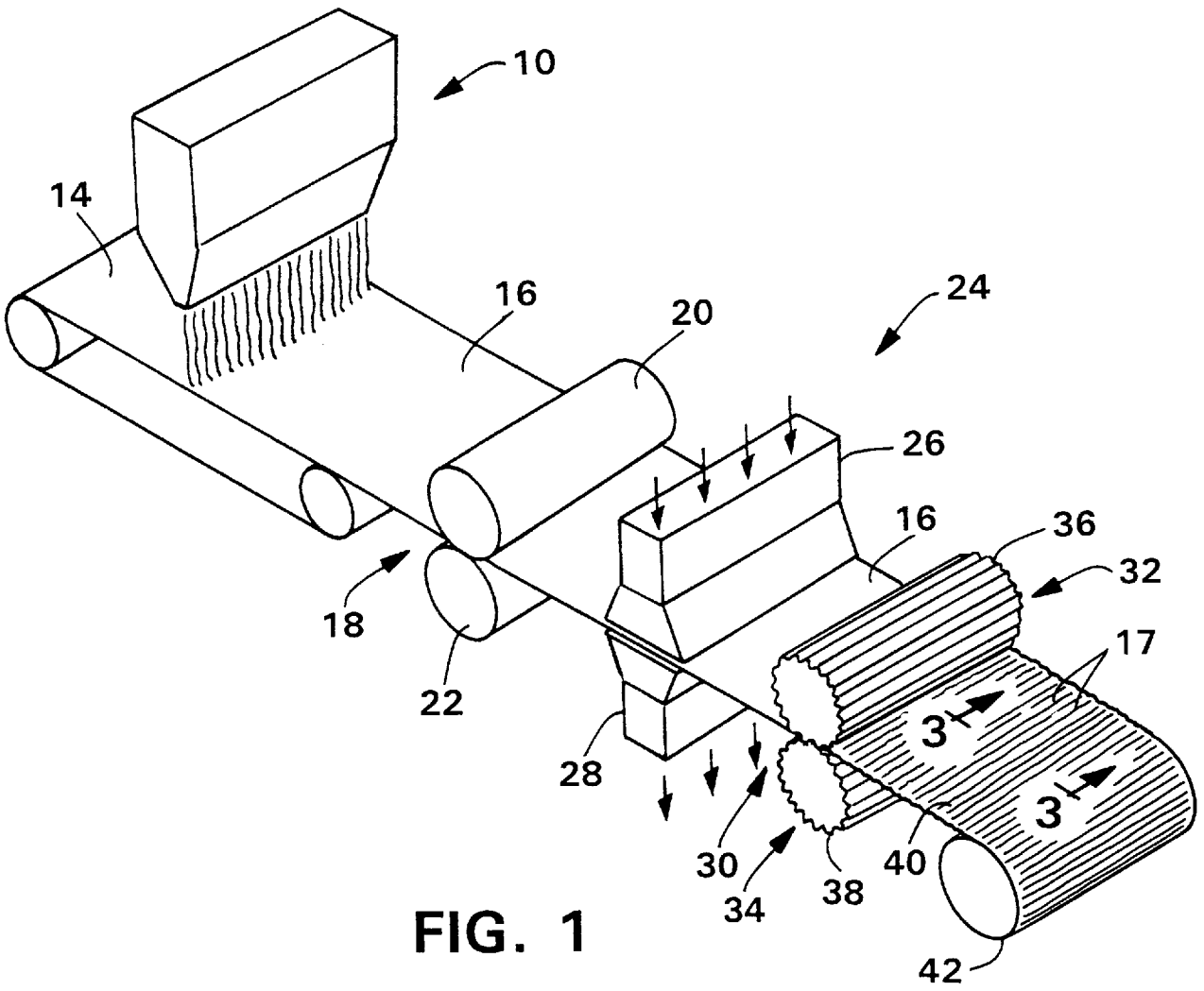
FIG. 1 is a schematic illustration of a process for producing creased nonwoven webs in accordance with the present invention that are creased in the cross-machine direction.

Although the invention will be described in connection with the preferred embodiments, it will be understood that it is not intended to limit the invention to those embodiments. On the contrary, it is intended to cover all alternatives, modifications and equivalents as may be included within the spirit and scope of the invention as defined by the appended claims.

Certain terms used herein will be defined to facilitate an understanding of the invention. The term "creased" as used herein is intended to describe a generally regular, "V"-shape series of peaks and valleys permanently formed into the nonwoven web and extending continuously in a direction of the web. However, it should be understood that the term is not meant to exclude more rounded or "U"-shapes or even square-shaped peaks and valleys. The term "percent stretch" as used herein is defined by multiplying by 100 the fraction obtained by dividing the difference between a stretched length ($L_s$) and an initial length ($L_i$) by the initial length. The term "percent recovery" as used herein is defined by multiplying by 100 the fraction obtained by dividing the difference between $L_s$ and the recovered length ($L_R$) by the difference between $L_s$ and $L_i$. The method for obtaining these lengths is described in detail hereinafter.

Since it is the structure of the web of the present invention which is largely responsible for the improvements obtained, the raw materials used may be selected from a wide variety. For example, and without limiting the generality of the foregoing, thermoplastic polymers such as polyolefins including polyethylene, polypropylene as well as polystyrene may be used as may be polyesters including polyethylene terephalate and polyamides including nylons. While the base or precursor web is not inherently elastic, it is not intended to exclude compositions including a minor amount of other thermoplastic polymers such as those which are elastomeric including elastomeric polyurethanes and block copolymers although it is to be understood that it is a feature of the invention that elastomeric compositions are not necessary to obtain the benefits of the invention. Compatible blends of any of the foregoing may also be used. In addition, additives such as processing aids, wetting agents, nucleating agents, compatibilizers, wax, fillers and the like may be incorporated in amounts consistent with the fiber forming process used to achieve desired results. Other fiber or filament forming materials will suggest themselves to those skilled in the art. It is only essential that the composition be capable of spinning into filaments or fibers of some form that can be deposited on a forming surface and thermally shaped into permanent corrugations or creases as further described below. Since many of these polymers are hydrophobic, if a wettable surface is desired, known compatible surfactants may be added to the polymer as is well-known to those skilled in the art. Such surfactants include, by way of example and not limitation, anionic and nonionic surfactants such as sodium diakylsulfosuccinate (Aerosol OT available from American Cyanamid) and ehtyoxylated octyl phenol (Triton X-102 available from Union Carbide). The amount of surfactant additive will depend on the desired end use as will also be apparent to those skilled in this art. Other additives such as pigments, fillers, stabilizers, compatibilizers and the like may also be incorporated. Further discussion of the use of such additives may be had by reference to U.S. Pat. No. 4,374,888 to Bornslaeger dated Feb. 22, 1983, for example, and U.S. Pat. No. 4,070,218 to Weber dated Jan. 24, 1978, for example.

The basis weight for nonwoven fabrics produced in accordance with the invention will vary widely depending upon the intended use. For example, very lightweight webs having a basis weight in the range of from about 10 grams per square meter to 50 grams per square meter or even lighter in some cases are useful as liners for disposable diapers, containment flaps for disposable diapers, or for covers, liners or transfer layers and as a component of other personal care products such as sanitary napkins. The transfer layer in such a product is positioned between the absorbent layer and the liner and serves to distribute fluid passing through the liner in a manner to achieve maximum utilization of the absorbent medium. Somewhat heavier basis weights will serve for applications such as washcloths, towels and the like and as various garment components, which generally will have a basis weight in the range of from about 20 grams per square meter to about 70 grams per square meter. Still heavier products in the basis weight range of from about 70 grams per square meter to 300 grams per square meter or even higher can be engineered to be stiffer and find uses such as a scrubber for auto windshields, for example, or for household uses. For other applications, such as, for example, bath mats, it may be useful to laminate a nonwoven fabric having corrugations produced in accordance with the present invention with an absorbent bottom layer to provide desired absorption and rigidity to the product. Examples of other products or combinations requiring similar or different nonwoven basis weights will be apparent to those skilled in the art, and some will be discussed in detail below.

The number of creases for the nonwoven fabrics produced in accordance with the invention is not critical, but will be generally within the range of from about 2 to about 55 per centimeter measured in a direction orthogonal to the creases, and, for many applications, will desirably be within the range of from about 5 to about 40 per centimeter. The shape of the individual creases as indicated above, will be generally "V"-shaped, and the height will be selected in accordance with the desired web properties. For example, at the lower end of the number of creases per centimeter, the height may generally be higher in range from 0.5 to about 1.7 centimeters as measured vertically from a valley to the adjacent peak. For higher numbers of creases per centimeter, the height may be reduced, for example, down to the range of about 0.08 to about 0.17 centimeters. In all cases, the creases are permanent in the sense that, when the nonwoven fabric is relaxed, they tend to return and provide stretch and recovery properties as further discussed in detail below. The filament or fiber forming process used may vary widely as may the characteristics of the fibers or filaments themselves. For example, continuous spunbond filaments may be used as well as meltblown continuous or discontinuous microfibers. Furthermore, multicomponent or multiconstitutent fibers are useful, and mixtures with powders such as superabsorbent or natural fibers such as wood pulp may also be used depending upon the desired end use properties.

Turning to FIG. 1, a process for producing the creased nonwoven fabric of the present invention is illustrated. As shown, filament forming device 10, illustrated as, for example, spunbond apparatus, deposits filaments 12 on forming wire 14 creating web 16 which is directed through compacting roll nip 18 comprising compaction rolls 20 and 22. Web 16 is then directed to through-air heater 24 including heated air supply 26 and vacuum assist 28. Heater 24 may provide bonding to web 16 and/or it may be bonded by other means (not shown) such as a separate through-air or point bonder in which case heater 24 may be omitted or may provide supplemental heating to maintain web 16 at a desired temperature for creasing. While still heated, web 16 is then directed to nip 30 between geared rolls 32 and 34. Rolls 32 and 34 have complementary grooves 36, 38 which act to deform web 16 producing creases 17 extending across the web and compacting the overall length of web 16. As will be apparent to those skilled in the art, the web forming end including, for example, spunbond former 10 may be omitted if preformed webs are used. The creased web 40 may be forwarded immediately for use or, as would normally be the case, wound into rolls 42 for shipment or storage.

Figure 2:
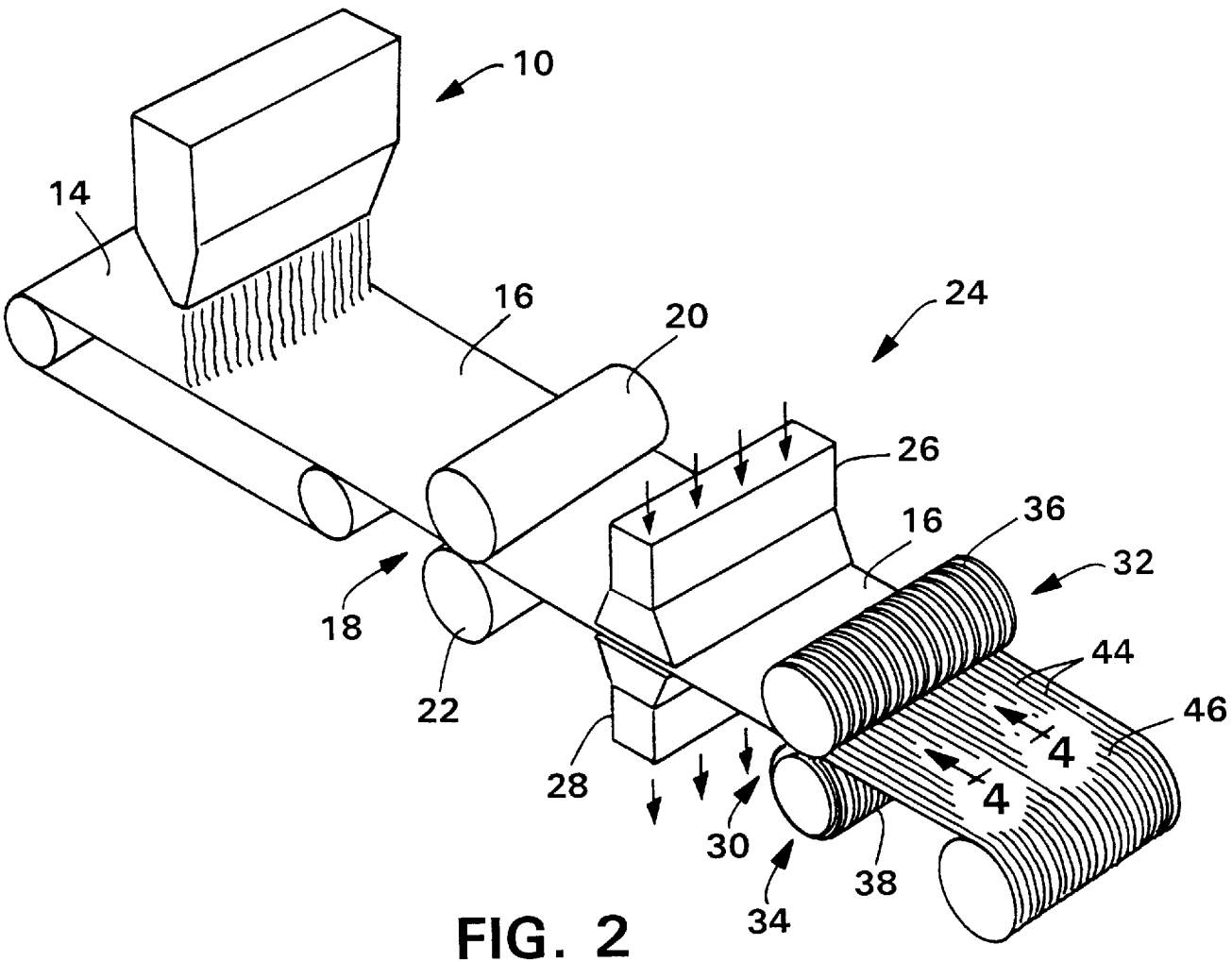
FIG. 2 is a schematic of a process for producing creased nonwoven webs in accordance with the present invention with creases extending in the machine direction.

Turning to FIG. 2, an alternative embodiment wherein the web is creased in the opposite direction is illustrated and will be described. Like elements are numbered the same in both FIGS. As will be understood, in this case geared rolls 32 and 34 are replaced by a series of complementary discs which act to deform web 16 forming creases 44 extending in the machine direction of creased web 46.

Figure 3:
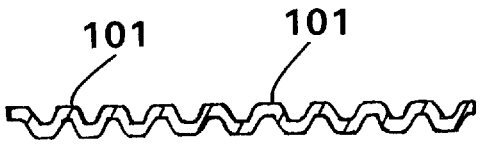
FIGS. 3 and 4 illustrate creased nonwoven webs in accordance with the present invention.

FIG. 3 is a schematic illustration of a cross-section of creased web 40 showing creases 101.

Figure 4:
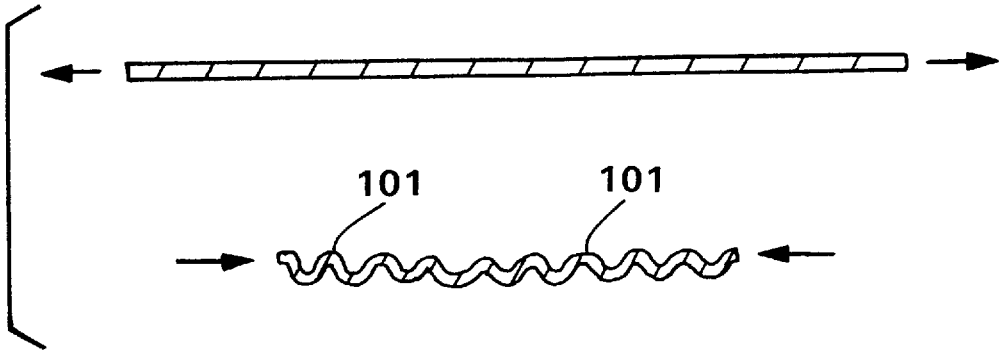

FIG. 4 is a two part illustration of the web of FIG. 3 is a stretched condition and then after relaxation and return to the creased condition.

For certain applications it will be desirable to utilize multicomponent fibers in which case either the spunbond former 10 will be designed in accordance with technology known to those skilled in the art to form multicomponent filaments such as are described in coassigned U.S. Pat. No. 5,382,400 to Hershberger, Brown, Pike, Gwaltney and Siegel dated 17 Jan., 1995, incorporated herein by reference in its entirety or, alternatively, the preformed precursor web will be a multicomponent fiber or filament web.

Figure 5:
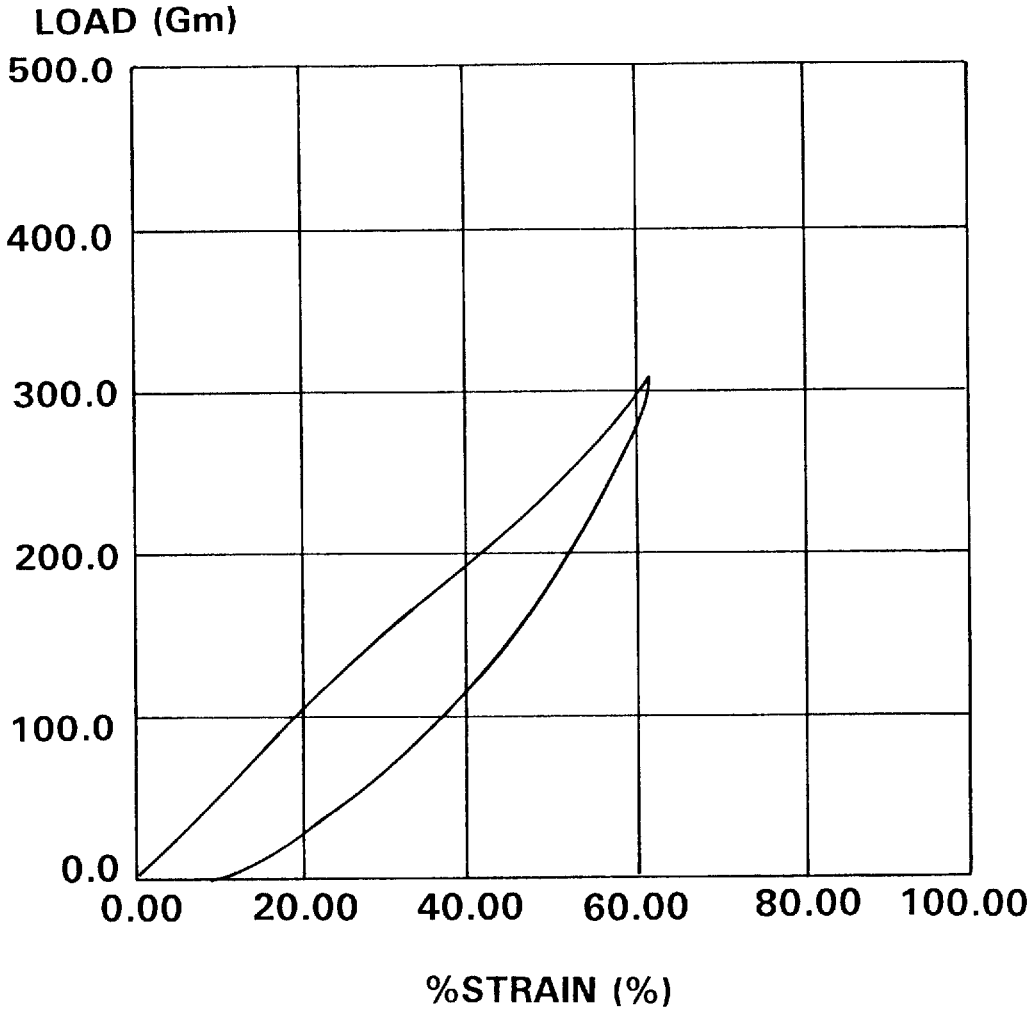
FIGS. 5 and 6 illustrate stretch and recovery properties obtained in accordance with the present invention as compared with a control material.

FIG. 5 is a hysteresis curve showing improvements in stretch properties obtained in accordance with the present invention. As can be seen, permanent set is minimal, if any.

Figure 6:
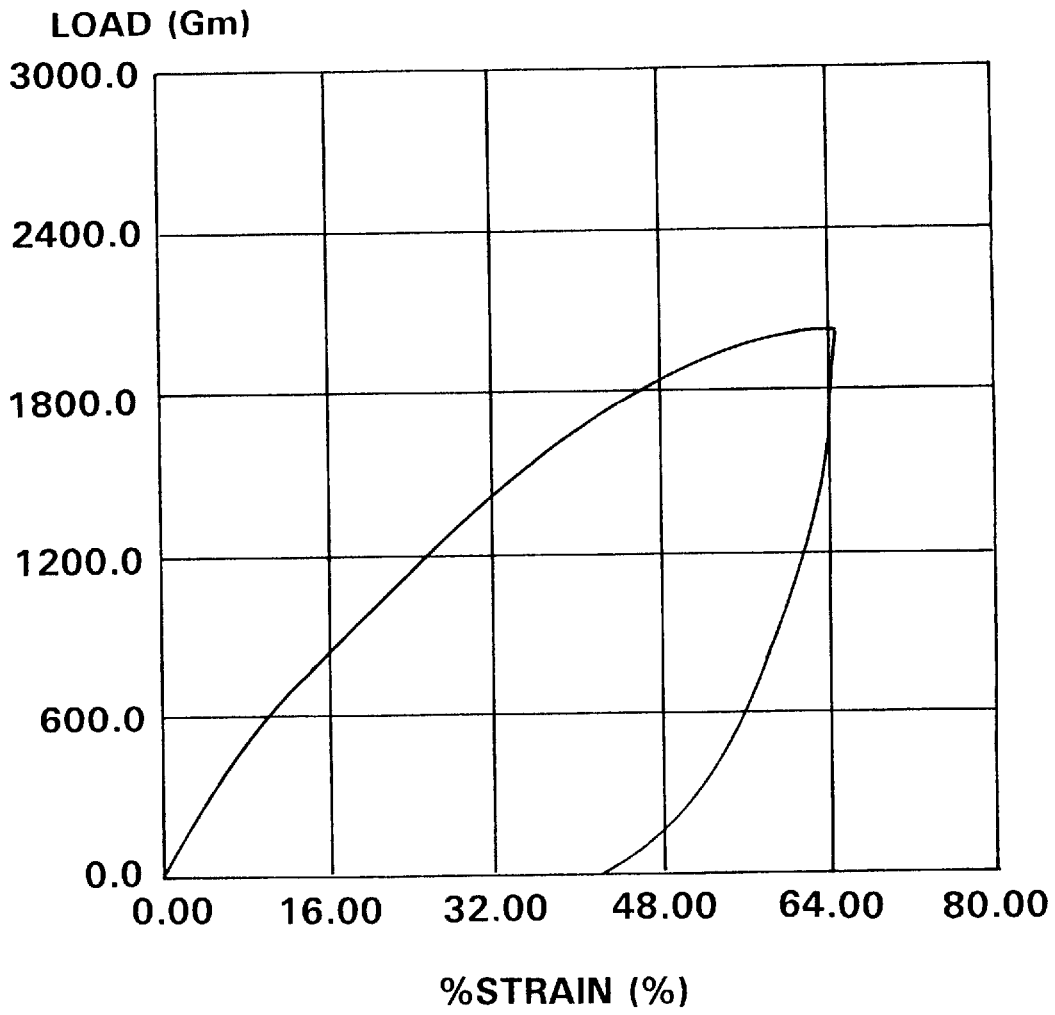

FIG. 6 is a graph like FIG. 5 only of a comparative control material. The amount of permanent set is readily apparent from the fact that the difference between the intersections of the x-axis is in the range of 40%.

Figure 7:
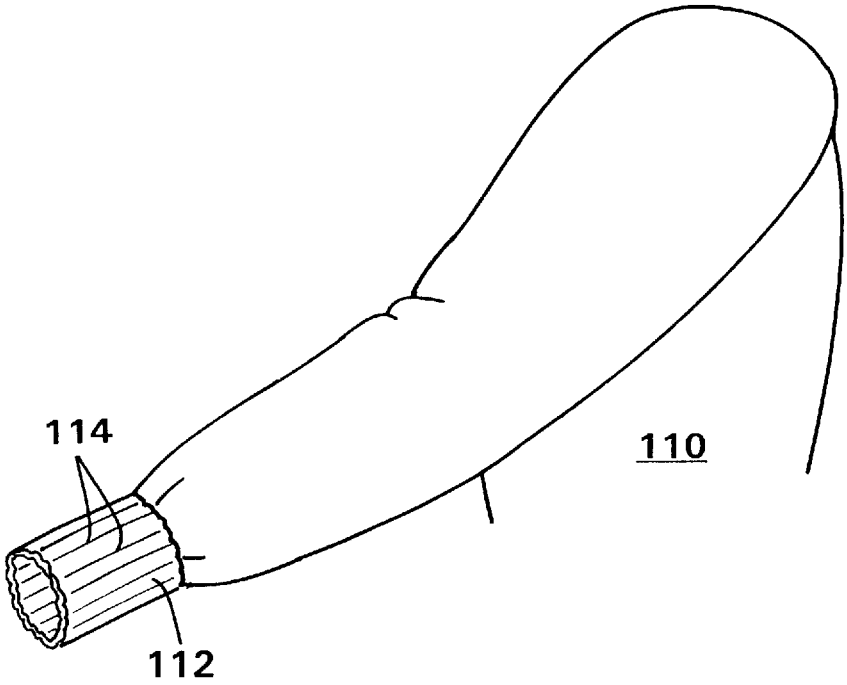
FIG. 7 illustrates a garment in accordance with the invention using the creased nonwoven web as a stretchable cuff.

FIG. 7 illustrates a garment application showing in partial view, for example, a surgical gown 110 having a cuff 112 made of the material of the invention having creases 114.

Figure 8:
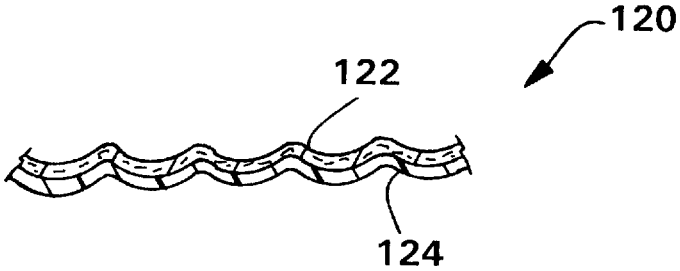
FIG. 8 illustrates a creased laminate in accordance with the invention.

FIG. 8 illustrates the material of the invention in the form of a laminate 120 of nonwoven layer 122 and film layer 124.

Depending upon the desired end results, certain parameters are important as affecting the overall web properties. The basis weight of the starting web material will dictate to some degree the other important parameters. For example, a very heavy basis weight material may necessitate a greater volume of heated air in the through-air heater in order to effectively raise the temperature of the web. Similarly, the grooves in the geared rolls will be configured so as to accommodate the web basis weight. In general, most applications will utilize basis weights in the range of from about 5 gsm to about 150 gsm. For many applications the basis weight will be within the range of from about 10 gsm to about 40 gsm while other applications will use basis weights within the range of from about 40 gsm to about 110 gsm. Also, the bulk of the starting web will affect these process parameters to some degree. The bulk may vary widely from about 0.01 cm to about 1.3 cm. For applications such as liners for personal care products, for example, the starting bulk will be in the range of from about 0.01 cm to 0.06 cm whereas other applications, such as filter materials, will more effectively use thicker starting webs with a bulk in the range of from about 0.06 cm to about 1.3 cm. Intermediate bulks of, for example, about 0.02 cm to 0.3 cm, are useful for surge layers. In general, the lighter the basis weight and lower the bulk, the easier it will be to form higher numbers of creases in the web at higher line speeds.

Another important parameter is the temperature at which the web is subjected to the corrugation step such as grooved roll or discs. It is important that the temperature be high enough that the creases in the consolidated web are heat set at least to some degree. Normally this will require a temperature above the softening point of at least a major component of the web but below the melting point of any of the web components. This temperature may be obtained by controlling the temperature of the heater such as the through-air heater as illustrated. As will be apparent to those skilled in the art, other heating means such as ovens, ultrasonics, steam and the like may be employed instead of or in addition to the illustrated through-air heater. If additional heating is desired, either or both of the geared rolls or the discs may be heated. To some extent the actual temperature within the equipment will take into consideration the line speed as will be apparent to those skilled in the art. Higher line speeds may require or withstand higher temperatures.

It is also possible, particularly where the creases extend in the machine direction, to vary the number of creases and locations across the web to produce, for example, a web having lower bulk edge portions while higher bulk properties in the central portions and vice versa. Other variations will be apparent to those skilled in the art.

The base web may be formed from a wide variety of thermoplastic compositions including blends of different polymers. For example, and without limiting the generality of the foregoing, thermoplastic polymers such as polyolefins including polyethylene, polypropylene as well as polystyrene may be used as may the polyesters and nylons. Blends of different fibers may be used as may the multicomponent fibers having two or more polymers arranged in distinct locations. Such multicomponent fibers are known and may be produced, for example, as described in above-mentioned coassigned U.S. Pat. No. 5,382,400 which is incorporated herein in its entirety by reference.

It is also contemplated that webs in accordance with the present invention may be produced in the form of laminates including multiple webs and/or films capable of being heat set in the creased condition described herein.

Webs in accordance with the invention may be further illustrated in terms of certain test parameters. Test results described herein were obtained as follows: Bulk results were obtained by measuring the thickness of a four inch square sample under a five inch square plexiglass plate applying 0.025 psig pressure.

Stretch and Recovery

A sample 1"×6" was prepared with the creases normal to the long dimension. The sample was suspended from a clip and a pretension weight (9.24 gram) was attached to the bottom end. The initial length ($L_i$) was recorded. A test weight was added to the pretension weight to bring the total load to the desired level (e.g. 300 grams). The stretched length ($L_s$) was recorded. The test weight was removed, leaving only the pretension weight. The recovered length ($L_R$) was recorded. A single test weight or a cycle of weights was used for each sample.

$$\%\ \text{Stretch} = \frac{(L_s - L_i) \times 100}{L_i}$$

$$\%\ \text{Recovery} = \frac{(L_s - L_R) \times 100}{L_s - L_i}$$

Method 1—100 g, 200 g, 300 g and 500 g test weights were used in sequence on a single sample. Initial, stretched and recovered lengths are recorded for each weight. % Stretch and % Recovery were recorded for each weight. A final % set (permanent stretch) was calculated using the 1st initial (100 g) and the 500 g recovered length.

$$\%\ \text{Set} = \frac{L_R(500) - L_i(100)}{L_i(100)} \times 100$$

Method 2 —Initial, stretched, and recovered lengths were determined with 300 g as the single test weight.

Creases per centimeter were measured as the average of three counts made visually on samples three inches (7.62 cm) in width orthogonal to the direction of the creases.

Hysteresis was measured by using a Sintech 1/S tester. A one inch (2.54 cm) by seven inches (17.8 cm) sample was subjected to three cycles to a target elongation of 60%. Creased materials were run with a 500 gram load cell, and uncreased materials were run with a 50 pound (~22,680 gram) load cell. The crosshead speed was 500 mm per minute, and the gage length was set at three inches (7.62 cm). A curve was generated for % strain vs load (g). The load was reported at incremental per cent elongation and the total set calculated using the formula of Method 1 above.

EXAMPLES

The invention will now be illustrated by means of examples. These examples are not intended to be limiting in any way and extensions and modifications thereof without departure from the spirit and scope of the invention and the claims will be apparent to those skilled in the art.

SAMPLE DESCRIPTIONS

Sample A was a 1.0 ounce per square yard (osy) (34 gsm) basis weight side-by-side bicomponent spunbond web of 50%/50% Exxon 3445 polypropylene and Dow 6811A linear low density polyethylene bonded with a wireweave bond pattern of about 15% coverage and about 48 bonds per square centimeter. Sample B was a 34 gsm monocomponent spunbond web of Exxon 3445 polypropylene with the same bond pattern as Sample A. Sample C was a 34 gsm melt-blown web of Himont PF 015 polypropylene having a diamond bond pattern of about 17% coverage and 19 bonds per square centimeter (EHP). Sample D was a 34 gsm bicomponent spunbond with an Exxon 3445 polypropylene sheath and Custom 401-D nylon 6 core 50%/50% by weight and bonded with a diamond bond pattern of about 25% bond area and 31 bonds per square centimeter (H-P). Sample E was the same as D except that the sheath was Dow 6811A linear low density polyethylene. Sample F was a laminate of the 0.5 osy (17 gsm) Exxon 3445 polypropylene spunbond bonded with the pattern of Sample A with a 0.4 mil film of a blend of polyethylenes the composite being bonded with a baby objects pattern with about 12% bond area. Sample G was a 17 gsm bicomponent spunbond like that of Sample E except that the core was Exxon 3445 polypropylene. Sample H was a 51 gsm side-by-side bicomponent spunbond web with Exxon 3445 polypropylene and Dow 6811A linear low density polyethylene that was through-air bonded. Sample I was the same as Sample H except that the basis weight was 68 gsm. Table 1 sets out bulk, stretch and recovery data for the precursor webs.

TABLE 1

Precursor Webs

| Sample | Bulk inches | 100 g % Stretch | % Recovery | 200 g % Stretch | % Recovery | 300 g % Stretch | % Recovery | 500 g % Stretch | % Recovery | Total % Set |
|---|---|---|---|---|---|---|---|---|---|---|
| A | 0.015 | 1.46 | 100.00 | 2.19 | 100.00 | 3.65 | 100.00 | 6.57 | 88.89 | 0.73 |
| B | 0.014 | 0.72 | 100.00 | 0.72 | 100.00 | 1.45 | 100.00 | 2.17 | 100.00 | .00 |
| C | 0.012 | 0.72 | 100.00 | 1.45 | 100.00 | 2.90 | 100.00 | 9.42 | 76.92 | 2.17 |
| D | 0.012 | 0.74 | 100.00 | 1.48 | 100.00 | 2.96 | 100.00 | 4.44 | 83.33 | 0.74 |
| E | 0.010 | 0.57 | 100.00 | 1.13 | 100.00 | 1.69 | 100.00 | 3.10 | 72.20 | 0.85 |
| F | 0.021 | 1.47 | 100.00 | 3.68 | 100.00 | 4.41 | 100.00 | 11.76 | 93.75 | 0.74 |
| G | 0.014 | 0.83 | 100.00 | 1.38 | 83.30 | 1.38 | 66.70 | 3.01 | 72.20 | 1.66 |
| H | 0.027 | 0.81 | 100.00 | 1.35 | 100.00 | 1.90 | 80.50 | 4.55 | 88.60 | 1.08 |
| I | 0.084 | 6.72 | 77.78 | 11.76 | 81.25 | 18.71 | 76.92 | 33.79 | 65.31 | 20.90 |

Example 1

For these runs, apparatus as illustrated in FIG. 1 was used except that the webs were preformed and not formed directly in line with the pleating step. To apply the creases to these samples, steel rolls having lengthwise grooves of 0.254 cm width and 0.2 cm depth on a diameter of 14 cm were used and operated in an intermeshing manner as shown in FIG. 1. Heat was applied directly to the web using air at varying temperatures and flow rates as indicated below, and the rolls were driven at the same speed providing a web travel of 7.6 meters per min. One to five runs were made for each sample with the operating conditions varied as set forth in Table 2 below. The number of creases per centimeter of web length varied depending on the basis weight and operating conditions, but was generally in the range of from about 2 to about 5 per cm. Bulk results are an average of five measurements.

TABLE 2

| Sample | Air Temperature F | Air Flow cfm | Roll psi | % Stretch 300 g | % Recovery | Bulk inches | Creases/cm |
|---|---|---|---|---|---|---|---|
| A | 274 | 90 | 90 | 8.40 | 68.0 | 0.0440 | 3.0 |
| | 281 | 90 | 90 | 13.10 | 66.0 | 0.0530 | 3.4 |
| | 293 | 150 | 90 | 32.70 | 67.0 | 0.0630 | 3.5 |
| | 299 | 195 | 90 | 61.60 | 60.0 | 0.0740 | 4.4 |
| B | 297 | 195 | 90 | 3.70 | 59.0 | 0.0520 | 2.6 |
| | 333 | 90 | 90 | 57.00 | 78.0 | 0.0670 | 3.6 |
| | 343 | 200 | 90 | 62.60 | 82.0 | 0.0750 | |
| | 337 | 160 | 90 | 57.70 | 81.0 | 0.0760 | 4.4 |
| C | 324 | 120 | 90 | 8.90 | 45.0 | 0.0770 | 3.7 |

TABLE 2-continued

| Sample | Air Temperature F | Air Flow cfm | Roll psi | % Stretch 300 g | % Recovery | Bulk inches | Creases/cm |
|---|---|---|---|---|---|---|---|
| | 322 | 90 | 90 | 26.50 | 38.0 | 0.0710 | 3.8 |
| D | 319 | 90 | 90 | 24.30 | 63.0 | 0.0540 | 3.4 |
| | 320 | 110 | 90 | 29.20 | 62.0 | 0.0550 | 3.6 |
| | 325 | 150 | 90 | 18.40 | 67.0 | 0.0470 | 3.3 |
| E | 288 | 100 | 90 | 38.40 | 64.0 | 0.0570 | 3.9 |
| | 288 | 130 | 90 | 33.60 | 63.0 | 0.0590 | |
| | 289 | 150 | 90 | 26.80 | 65.0 | 0.0540 | 3.8 |
| | 289 | 180 | 90 | 28.90 | 61.0 | 0.0580 | 3.8 |
| | 290 | 200 | 90 | 32.60 | 62.0 | 0.0540 | 3.6 |
| F | 280 | 200 | 88 | 3.72 | 78.3 | 0.0180 | 2.5 |
| | 290 | 200 | 88 | 5.02 | 86.1 | 0.0315 | 2.6 |
| G | 298 | 200 | 88 | 26.20 | 59.2 | 0.0613 | 4.1 |
| H | 300 | 200 | 88 | 46.30 | 72.9 | 0.0590 | 4.3 |

Table 3 illustrates the effect of omitting heat from the creasing step in producing the samples of Examples l-XV. In each case runs were made without heat applied to the creasing as indicated.

TABLE 3

| Sample | Air Temperature F | Air Flow cfm | Roll psi | % Stretch 300 g | % Recovery | Bulk inches | Creases/cm |
|---|---|---|---|---|---|---|---|
| A | Off | 0 | 90 | 7.00 | 76.0 | 0.0180 | 0 |
| B | Off | 0 | 90 | 2.00 | 78.0 | 0.0130 | 0 |
| C | Off | 0 | 90 | 7.14 | 78.5 | 0.0140 | 0 |
| D | Off | 0 | 90 | 1.70 | 83.3 | 0.0090 | 0 |
| E | Off | 0 | 88 | 2.24 | 77.8 | 0.0105 | 0 |
| H | Off | 0 | 90 | 5.02 | 85.0 | 0.0278 | 0 |

As is demonstrated by the foregoing, the present invention provides permanent creases and increased bulk to the resulting nonwoven fabric.

Table 2 also shows the effect of different treatment temperatures on the properties of the webs of the examples and that higher temperatures have a tendency to increase both the number of crimps and the bulk.

Tables 4 and 5 provide direct comparisons of bulk, stretch and recovery tests for samples with and without heat applied.

TABLE 4

Bulk Comparisons

| Sample | Comparative Table #1 Bulk Inches | Hot Table #2 Bulk Inches | Cold Table #3 Bulk Inches |
|---|---|---|---|
| A | 0.015 | 0.074 | 0.018 |
| B | 0.014 | 0.076 | 0.013 |
| C | 0.012 | 0.071 | 0.014 |
| D | 0.012 | 0.055 | 0.009 |
| E | 0.010 | 0.059 | 0.011 |
| F | 0.021 | 0.032 | ****** |
| G | 0.014 | 0.061 | ****** |
| H | 0.027 | 0.059 | 0.028 |

TABLE 5

Stretch and Recovery Comparisons

| Sample | Hot Table #2 % Stretch 300 g | % Recovery | Cold Table #3 % Stretch 300 g | % Recovery |
|---|---|---|---|---|
| A | 61.6 | 60.0 | 7.00 | 76.0 |
| B | 62.6 | 82.0 | 2.00 | 78.0 |
| C | 26.5 | 38.0 | 7.14 | 78.5 |
| D | 29.2 | 62.0 | 1.70 | 83.3 |
| E | 38.4 | 64.0 | 2.24 | 77.8 |
| F | 5.02 | 86.1 | ***** | ***** |
| G | 26.2 | 59.2 | ***** | ***** |
| H | 46.3 | 72.9 | 5.02 | 85.0 |

Stretch and recovery results are also much improved in accordance with the present invention.

Example 2

For these examples, equipment was used as described in FIG. 2 to provide creases running in the machine direction. In this case 5.5 inch (14 cm) OD rolls were formed by 1/32 inch washers spaced apart by three spacers making grooves of 0.125 inch (0.32 cm) width and 0.10 inch (0.25 cm) depth. Two rolls intermeshed and were run under the same conditions as the prior described equipment. The washers and spacers were locked on a shaft by lock washers. Table 6 sets out operating conditions and test results obtained with these materials. Letter sample designations correspond to the descriptions above.

TABLE 6

| | | | MD lines | | | | | | | | | |
|---|---|---|---|---|---|---|---|---|---|---|---|---|
| Sample | Air Temp | Bulk inches | 100 g % Stretch | Recovery | 200 g % Stretch | Recovery | 300 g % Stretch | Recovery | 500 g % Stretch | Recovery | Total % Set | Creases/cm |
| B | 242 | 0.018 | 2.24 | 66.67 | 2.96 | 100.00 | 3.70 | 80.00 | 5.88 | 87.50 | 2.24 | 3.54 |
| | 257 | 0.020 | 1.56 | 100.00 | 3.12 | 100.00 | 3.91 | 80.00 | 5.43 | 85.71 | 1.56 | 3.54 |
| | 284 | 0.022 | 5.34 | 85.71 | 6.06 | 75.00 | 6.72 | 88.89 | 8.89 | 91.67 | 3.82 | 3.48 |
| | 297 | 0.038 | 6.77 | 77.78 | 7.41 | 90.00 | 8.82 | 83.33 | 11.59 | 81.25 | 6.02 | 3.28 |
| | 337 | 0.052 | 6.67 | 100.00 | 11.67 | 85.71 | 13.11 | 87.50 | 19.35 | 91.67 | 5.00 | 3.41 |
| C | 259 | 0.024 | 4.55 | 83.33 | 6.77 | 88.89 | 10.45 | 78.57 | Failed | | | |
| | 282 | 0.028 | 5.26 | 85.71 | 8.21 | 81.82 | 11.03 | 86.67 | Failed | | | |
| A | 319 | 0.045 | | | | | | | | | | 3.15 |
| | 258 | 0.035 | 8.62 | 70.00 | 10.08 | 83.33 | 14.05 | 76.47 | 27.20 | 67.65 | 17.24 | 3.40 |
| | 282 | 0.037 | 5.00 | 80.00 | 8.91 | 88.89 | 13.73 | 85.71 | 29.81 | 70.97 | 13.00 | 3.28 |
| | 318 | 0.046 | 5.88 | 100.00 | 8.82 | 83.33 | 13.04 | 77.78 | 26.76 | 73.68 | 11.76 | |
| D | 260 | 0.017 | 1.56 | 100.00 | 2.34 | 100.00 | 3.12 | 75.00 | 4.65 | 100.00 | 0.78 | 3.44 |
| | 281 | 0.020 | 3.08 | 100.00 | 3.85 | 80.00 | 3.82 | 100.00 | 6.11 | 87.50 | 1.54 | 3.22 |
| | 303 | 0.026 | 3.85 | 100.00 | 5.38 | 85.71 | 6.11 | 100.00 | 7.63 | 90.00 | 1.54 | 3.41 |
| | 242 | 0.027 | 5.47 | 57.14 | 5.34 | 100.00 | 13.74 | 55.56 | 12.23 | 76.47 | 11.76 | 3.35 |
| I | 282 | 0.062 | 13.51 | 70.00 | 20.78 | 75.00 | 33.33 | 74.07 | 110.23 | 46.39 | 89.19 | 3.28 |
| | 302 | 0.059 | 7.55 | 75.00 | 24.07 | 76.92 | 50.88 | 62.07 | Failed | | | |
| F | 308 | 0.026 | 2.15 | 100.00 | 5.38 | 80.00 | 6.38 | 83.33 | 13.68 | 76.92 | 5.38 | 3.54 |
| | 241 | 0.033 | 1.48 | 100.00 | 2.22 | 100.00 | 3.70 | 80.00 | 7.35 | 80.00 | 2.22 | 3.35 |

Conditions:
100 psi roll pressure
240 cfm air flow
7.6 meters/min travel

As can be seen, comparable results are obtained with machine direction creasing. As will be apparent, other fabric or web layers may be used instead of or in addition to those shown.

I claim:

1. Nonwoven fabric having heat set creases of at least 2 per centimeter measured orthogonal to the creases lines and a bulk of at least 1.5 times the thickness of the base web, said nonwoven fabric having a recovery of at least 35% when subjected to 300 g stretch test in a direction orthogonal to the crease lines, said nonwoven fabric having been formed from a nonelastic olefin polymer based thermoplastic fiber-comprising precursor web.

2. The nonwoven fabric of claim 1 wherein said nonelastic base web comprises a propylene based polymer or copolymer.

3. The nonwoven fabric of claim 1 wherein the number of crease lines is within the range of from about 2 to about 55 per centimeter.

4. The nonwoven fabric of claim 3 wherein the number of crease lines is within the range of from about 5 to about 40 per centimeter.

5. The nonwoven fabric of claim 1 wherein said creases have an average height in the range of from about 0.03 centimeter to about 1.7 centimeters.

6. The nonwoven fabric of claim 5 wherein said creases have an average height in the range of from about 0.03 centimeter to about 0.17 centimeter.

7. The nonwoven fabric of claim 5 wherein said creases have an average height in the range of from about 0.5 centimeter to about 1.7 centimeters.

8. The nonwoven fabric of claim 1 wherein said nonelastic base web has a basis weight in the range of from about 10 gsm to about 50 gsm and a bulk in the range of from about 0.01 cm to about 1.3 cm.

9. The nonwoven fabric of claim 1 having a recovery of at least 60% after a 300 gram load test.

10. The nonwoven fabric of claim 9 having a total permanent set of less than 10% after 60% elongation.

11. The nonwoven fabric of claim 10 having a total permanent set of less than 7.5% after 60% elongation.

12. A garment having as a component the nonwoven fabric of claim 1.

13. The garment of claim 12 wherein said component comprises a cuff.

14. A wiper comprising the nonwoven fabric of claim 1.

15. A laminate comprising the nonwoven fabric of claim 1.

16. The laminate of claim 15 also comprising a second fibrous web.

17. The laminate of claim 15 also comprising a film.

18. The garment of claim 12 wherein said nonwoven fabric comprises multicomponent fibers.

19. The garment of claim 18 wherein said multicomponent fibers are crimped.

20. The garment of claim 13 wherein said nonwoven fabric comprises multicomponent fibers.

21. The garment of claim 20 wherein said multicomponent fibers are crimped.

22. A nonwoven fabric having heat set creases of at least 2 per centimeter measured orthogonal to the creases lines and a bulk of at least 1.5 times the thickness of the base web, said nonwoven fabric having a recovery of at least 35% when subjected to 300 g stretch test in a direction orthogonal to the crease lines, said nonwoven fabric having been formed from a nonelastic precursor web comprising multicomponent fibers.

23. The nonwoven fabric of claim 22 wherein said multicomponent fibers are crimped.

24. A method of forming a nonwoven fabric having a recovery of at least 35% when subjected to a 300 g stretch test by:

a. forming a nonelastic olefin polymer based thermoplastic fiber-comprising precursor web;

b. creasing said precursor web to form at least two creases per centimeter; and c. heat setting said creases.

25. The method of claim 24 wherein the creases are formed in the cross-machine direction.

26. The method of claim 24 wherein the creases are formed in the machine direction.

* * * * *